United States Patent [19]

Brejcha

[11] 4,155,596

[45] May 22, 1979

[54] TERRAZZO FLOOR SURFACING MACHINE

[75] Inventor: Robert J. Brejcha, Westchester, Ill.

[73] Assignee: R/B Manufacturing, Inc., Westchester, Ill.

[21] Appl. No.: 888,348

[22] Filed: Mar. 20, 1978

[51] Int. Cl.[2] ..... B24B 23/00; E01C 23/00

[52] U.S. Cl. ..... 299/40; 299/41; 51/177; 299/14

[58] Field of Search ..... 299/41, 85, 86, 14, 299/40; 51/177

[56] References Cited

U.S. PATENT DOCUMENTS

| | | | |
|---|---|---|---|
| 1,958,077 | 5/1934 | Vinella | 51/177 |
| 2,024,764 | 12/1935 | Hill | 299/41 |
| 3,221,619 | 12/1965 | Erickson | 299/41 X |
| 3,271,079 | 9/1966 | Simmons | 299/14 X |

*Primary Examiner*—Ernest R. Purser

*Attorney, Agent, or Firm*—Dulin, Thienpont, Potthast & Snyder, Ltd.

[57] ABSTRACT

A terrazzo grinding machine including a pair of motor driven rotatable co-axially disposed cutter holding spiders, the spiders being interconnected by means of a flexible coupling said spiders including a plurality of clusters of cutting discs supported on the spiders with their axes substantially parallel to the radii of the spiders.

15 Claims, 13 Drawing Figures

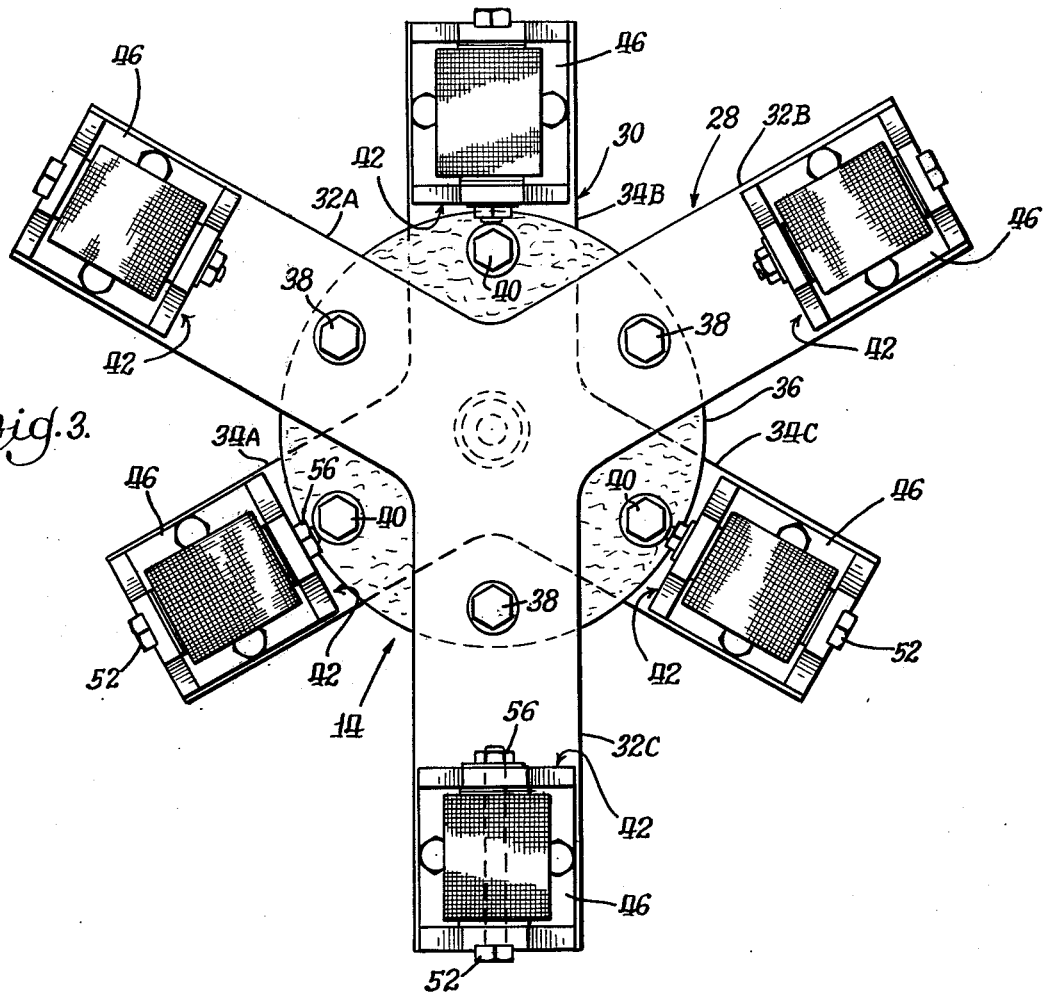
Fig. 3.
Fig. 4.
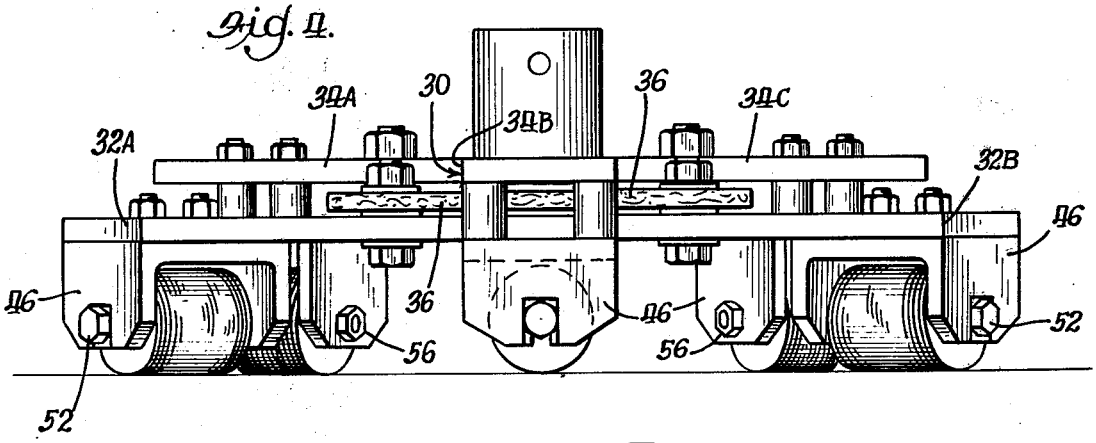
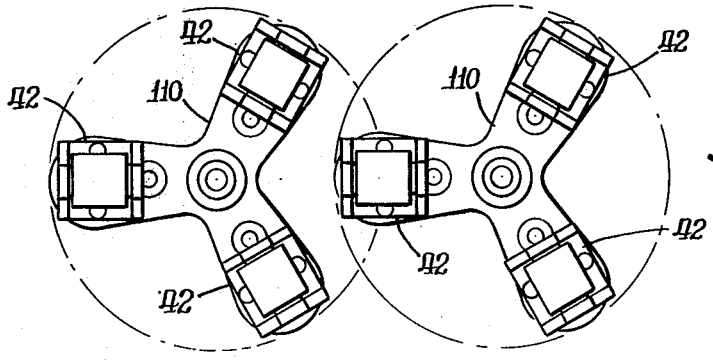
Fig. 9.

TERRAZZO FLOOR SURFACING MACHINE

This invention relates to devices for finishing cementitious cast surfaces and particularly for finishing terrazzo or other similar cast floors.

A variety of equipment exists which is used for finishing cement or terrazzo floors but all suffer from one or another defects. For example, in some of the equipment that is used, the grinding process (usually employing some form of abrasive) must be carried out wet, to eliminate the serious dust problem and reduce frictional horse power losses, and keep the grinding stones from becoming clogged with ground material; that is, the work surface must be wet and must be kept wet as the finishing process takes place. Some of the equipment uses abrasive grinding stones which are mounted on rotating discs or holders. These grinding stones have a tendency to wear quickly as well as unevenly and require frequent replacement resulting in substantial losses of time. Often times the finishing process depends directly on the weight of the machine to increase the grinding rate and obviously a heavy piece of equipment is much more difficult to manipulate by the one person usually manning the machine. In the case of terrazzo the grinding process normally is undertaken within a certain period of time after the floor is laid before the terrazzo achieves a final cure, otherwise the floor is virtually impossible to grind by conventional methods because of its excessive hardness. This often causes production scheduling problems.

Accordingly it becomes appropriate to develop an improved apparatus which takes into account and is designed to effectively deal with one or more of the above referred to deficiencies as well as others.

SUMMARY OF THE INVENTION

The present machine includes a cutter arrangement whereby a "crush grinding" effect is achieved when processing concrete or terrazzo surfaces. Advantage is taken of the inherent brittleness of concrete and terrazzo surfaces and their characteristic superficial surface failure under the action of concentrated compressive point loading. The effective use of the machine embodying the invention herein is best illustrated by the situation in which minute surface chipping would be experienced when a concrete or terrazzo surface (brittle substrate) is subjected to surface stress by hitting it with a sharply pointed instrument. In the immediate area of this concentrated loading a slight surface failure known as "spalling" occurs resulting in a very small amount of the material breaking away from the surface beneath and immediately surrounding the point of the instrument. I effectively utilize this concept by using an assembly of a number of thin sharply pointed or sharp edge cutter discs arranged side by side on a common axis and all held within a support in such a manner that the discs or wheels are free to rotate about their axis, each being free to move relative to the next.

The principal object of the invention is to provide improved apparatus for scarifying concrete or grinding terrazzo floor surfaces.

Another object of the invention is to provide equipment for finishing concrete and terrazzo floors which may be used without applying any wetting agent to the surface to be finished.

Another object is to provide terrazzo finishing equipment which may be used on the terrazzo installation even after the terrazzo has been fully cured.

Still another object of the invention is to provide in a terrazzo grinding machine a crush grinder assembly including a pair of co-axially disposed cutter carrying spiders which are interconnected with each other by a flexible coupling.

Another object is to provide a single drive axis terrazzo grinding machine as opposed to multiple parallel axes to thereby reduce the cost of manufacture.

Another object is to provide in a terrazzo grinding machine a plurality of crush grinder clusters of disc type cutter elements mounted on the arms of coaxially disposed rotatable spider elements.

A still further object of the invention is to provide in a terrazzo finishing machine having a rotatable crush grinder assembly a plurality of clusters of disc type cutter elements, said cutter elements being mounted on the spider arms and on axes lying along the radii of the spider arms.

A still further object is to provide in a terrazzo and concrete grinding machine a vibrator device for transmitting increased energy to the crush grinder assembly.

Other objects and advantages of the invention will become more apparent from the following description and accompanying drawings.

DETAILED DESCRIPTION OF THE DRAWINGS

FIG. 3 is a bottom plan view of a pair of co-axially disposed cutter carrying spiders with arms of unequal length used in the machine of FIG. 1;

FIG. 4 is a view in elevation of the cutter carrying spiders of FIG. 3;

Figure 1:
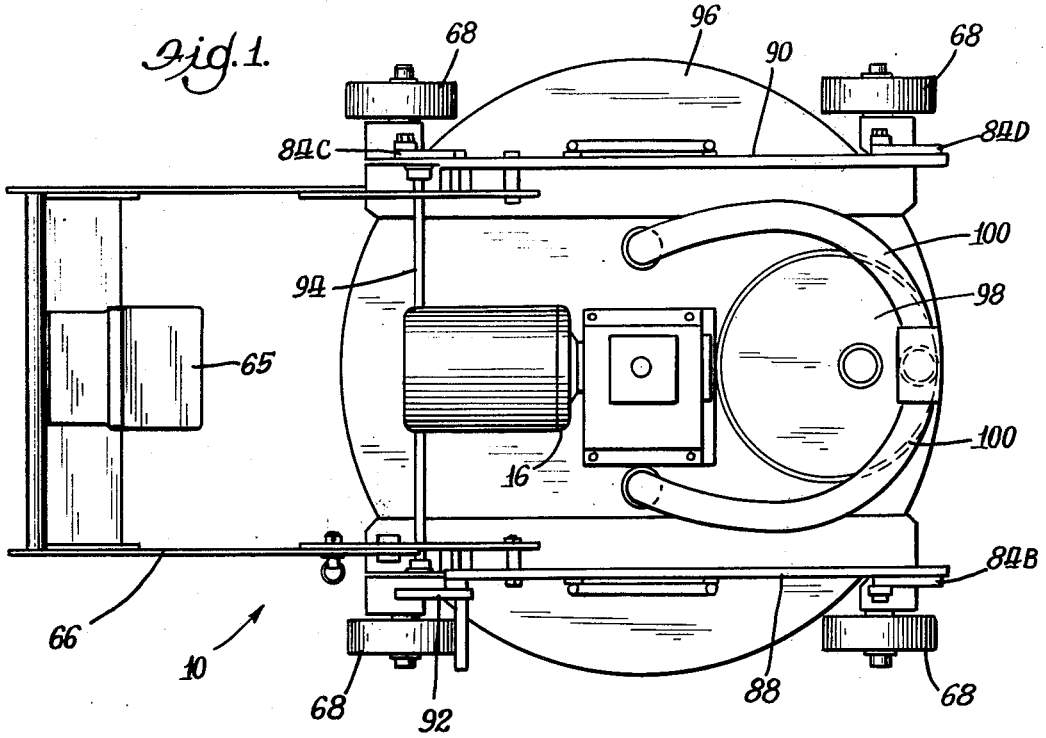
FIG. 1 is a plan view of a terrazzo surfacing machine embodying the invention herein.
Figure 7:
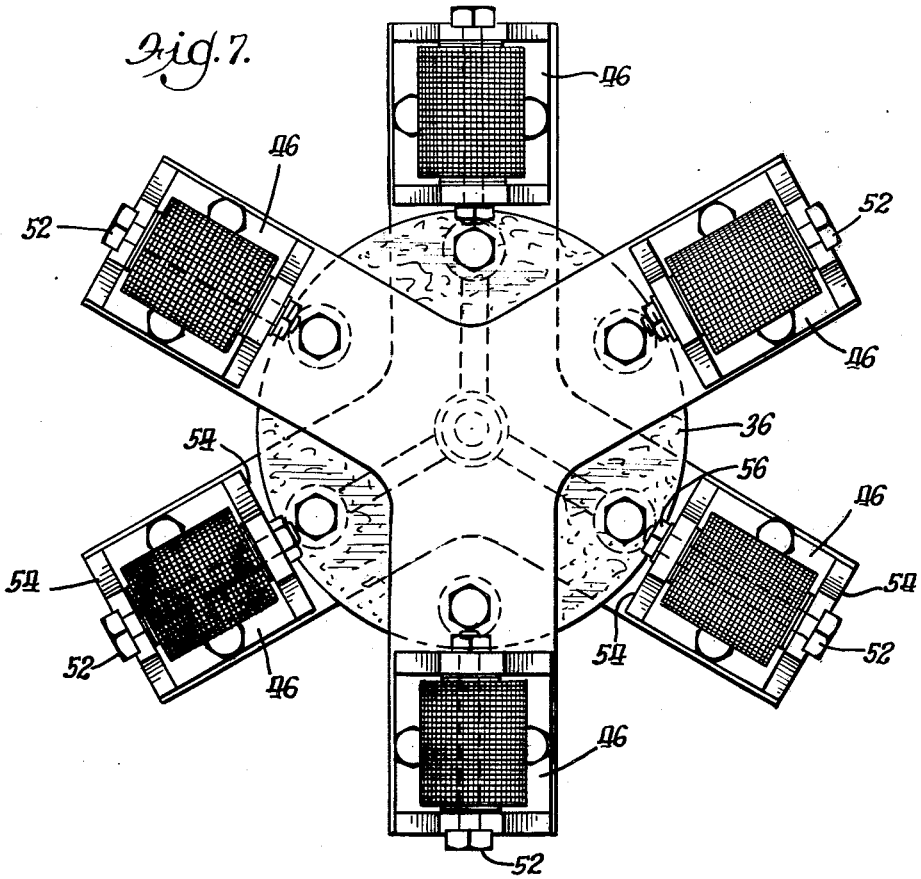
Figure 8:
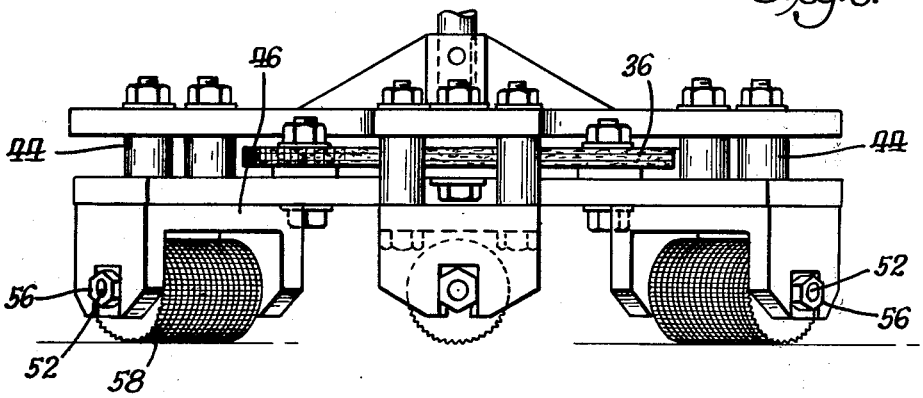
Figure 5:
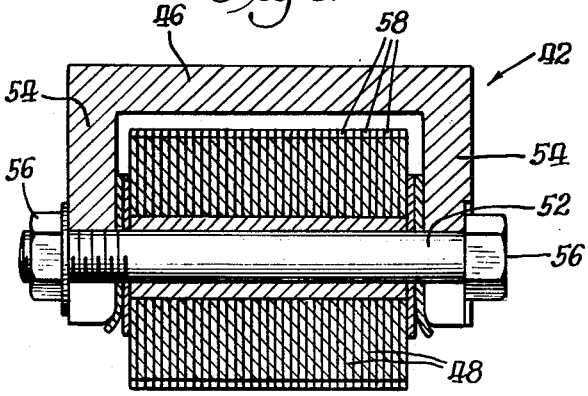
FIG. 5 is a view in elevation of a cutter assembly as mounted on the cutter carrying spider of FIGS. 3 and 4.
Figure 10:
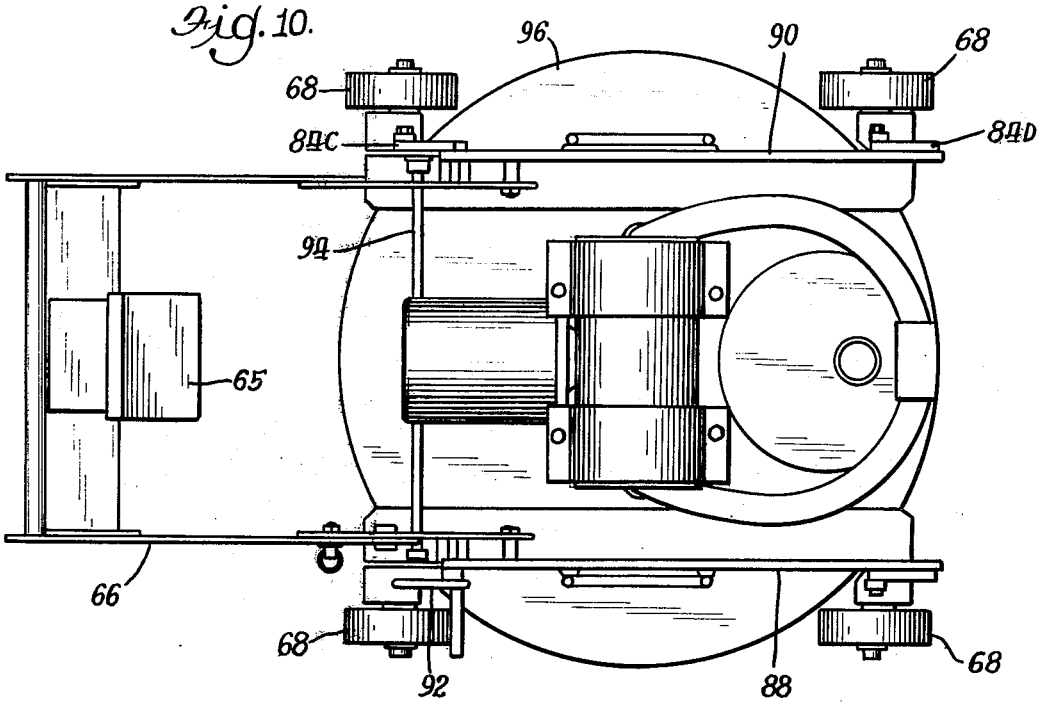
Figure 11:
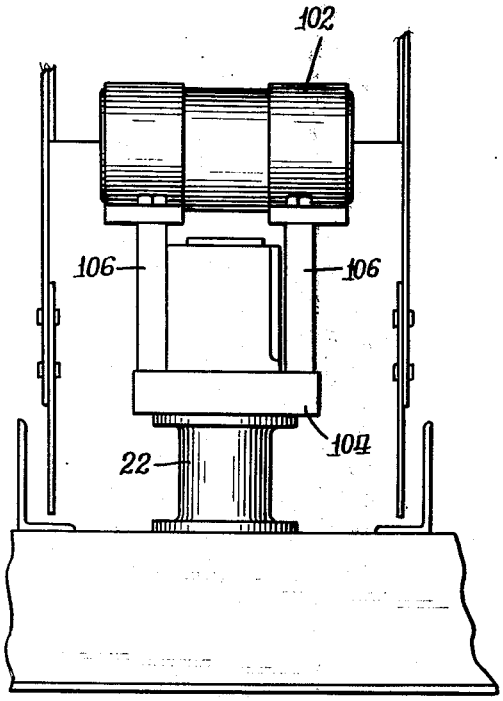
Figure 12:
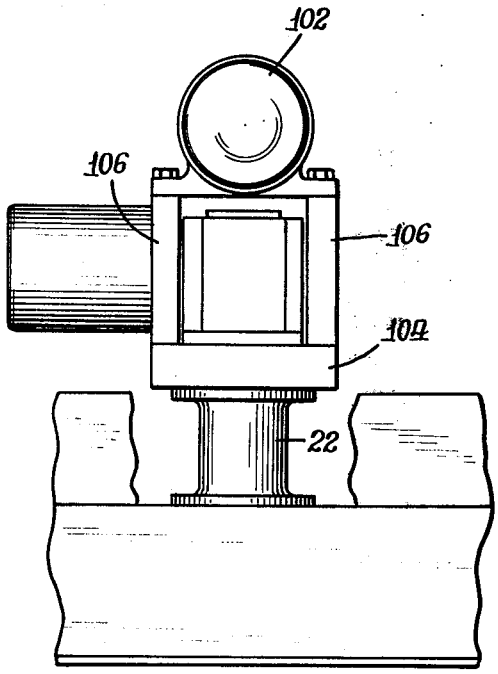

FIG. *6a* is a perspective view of one type of cutter blade which may be incorporated into the cutter assembly of FIG. 5;

FIG. *6b* is a perspective view of another type of cutter blade which may be incorporated in the cutter assembly of FIG. 5;

FIG. 7 is a bottom plan view of a pair of co-axially disposed cutter carrying spiders with arms of equal length utilizing the cutter assembly as shown in FIG. 5;

FIG. 8 is a view in elevation of the cutter carrying spiders of FIG. 7;

FIG. 9 is a bottom plan view of a pair of adjacently positioned cutter carrying spiders using the cutter assembly as shown in FIG. 5;

FIG. 10 is a plan view of a terrazzo surfacing machine similar to that of FIG. 1 but including a vibration unit;

FIG. 11 is a partial end view in elevation of the machine of FIG. 10 showing the vibration unit;

FIG. 12 is a partial side view in elevation of the machine of FIG. 10 showing the vibration unit.

DETAILED DESCRIPTION OF PREFERRED EMBODIMENT

We refer now to the drawings wherein like reference characters in the several views indicate similar parts.

Figure 2:
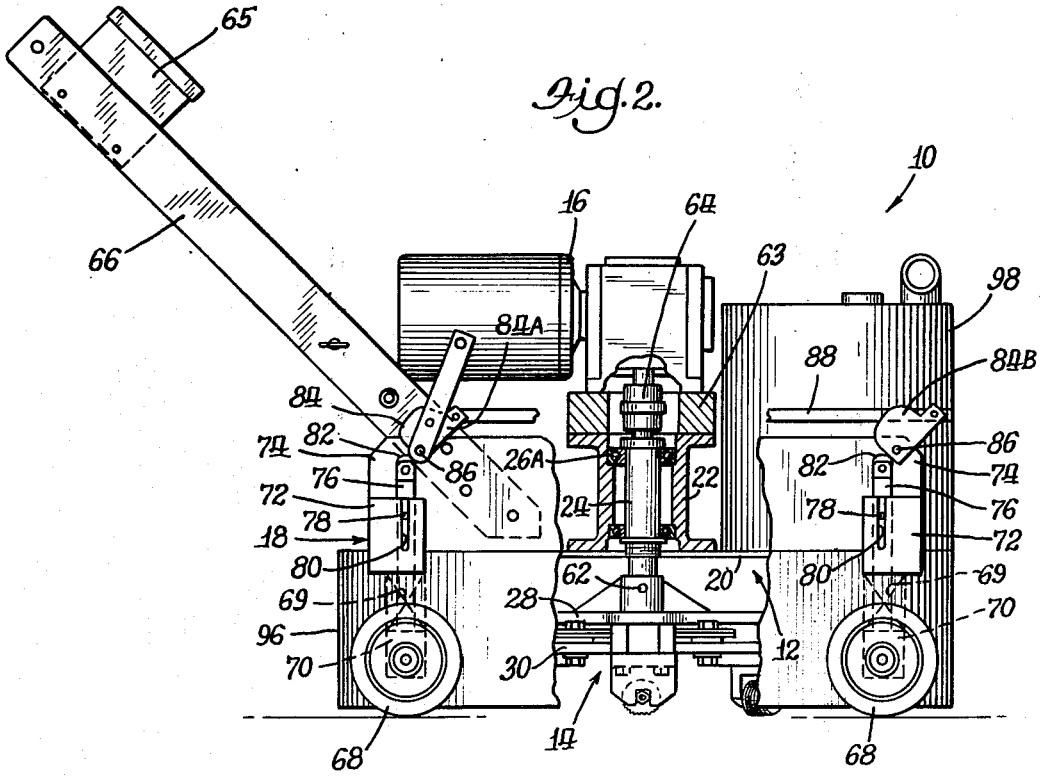
FIG. 2 is a view in elevation of the machine of FIG. 1 shown partially in section.

FIGS. 1 and 2 show respectively plan and elevation views of a terrazzo surfacing or finishing machine 10 embodying the invention herein. The machine 10 includes a main frame 12, a crush grinder assembly 14, a gear motor 16 and a wheel carriage assembly 18. The main frame 12 includes a structural base plate 20 to the upper part of which is bolted a bearing housing 22 which rotatably supports a drive shaft 24 in bearings 26A and 26B. The drive shaft 24 is held against axial movement in the bearing housing.

The crush grinder assembly 14 comprises a pair of co-axially disposed three-arm spiders 28 and 30 as shown in FIGS. 3 and 4. The upper spider 28 is formed with three equi-angular spaced arms 32A, 32B and 32C. Lower spider 30 is formed with three equi-angular spaced arms 34A, 34B and 34C. The two spiders 28 and 30 are interconnected by a flexible coupling 36.

The flexible coupling may be constructed in part of a conventional rubberized canvas plate assembly. Bolts 38 fasten the upper spider 28 to the upper side of the flexible coupling plate assembly. Bolts 40 fasten the lower spider 30 to the lower side of the flexible coupling plate assembly.

The co-axial spider arrangement with its flexible coupling contribute to higher productivity since six crush grinder clusters are in simultaneous contact with the floor while being driven by a single shaft. If six cutter clusters were otherwise mounted on a single rigid disc or spider it is more than likely that only three of the cutter clusters at best would have solid contact with the floor being processed at any one time.

Another advantage to the two spider co-axial arrangement with six cutter clusters is that the co-axial design is less costly than a two parallel axis design. The direct drive to only one shaft eliminates the costly gear box required when two parallel shafts are required to be driven as is the case with conventional machines.

A cutter stack or crush grinder cluster 42 of type shown in FIG. 5 is secured to each end of the three arms of both of the spiders 28 and 30. It will be observed then that the arms of upper spider 28 are somewhat longer than the arms of the lower spider 30. This is so that cutters will cover a greater surface area as the spiders rotate. In an alternative embodiment two spiders with arms of equal length could be used as shown in FIGS. 7 and 8. Since spider 28 is disposed in a horizontal plane above spider 30 spacer members 44 are used with the bolt attachment means to position cutter clusters on the spiders in the same plane.

Figure 6A:
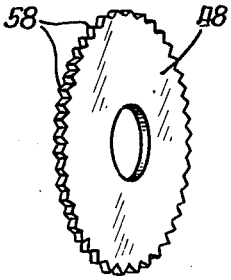
Figure 6B:
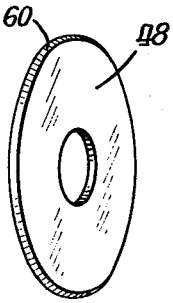

Each of the crush grinder clusters 42 comprises a substantially inverted U-shaped support 46 on which are carried a plurality of cutter discs 48 which are axially supported on a hardened cylindrical sleeve 50 which in turn fits over a hardened shaft 52 supported in the end walls 54 of the U-shaped support 46. The discs 48 may be approximately 1/16 inch thickness. As many as 40 discs might be used in a cluster. The hardened shaft may be a bolt threaded at its end to receive lock nut 56 for securing the shaft in the end walls of the U-shaped support. In a machine of 5 horse power or less each of the cutter discs 48 preferably are between 1–1½" in diameter and are formed with small sharp teeth 58 on the disc periphery as shown in FIG. 6*a*. In an alternative construction the cutter discs may be formed with a sharp peripheral knife edge. Another disc design may combine the features of FIGS. 6*a* and 6*b*. The grinding discs are free to rotate on the sleeve in the operating assembly. The sleeve in turn is free to rotate on its shaft 52. The cutter discs may be arranged closely together side by side as shown in FIG. 5 or in the alternative may be slightly separated by small spacers which may be approximately the thickness of the cutter discs themselves.

A very important feature of the invention herein is the effect achieved by using cutters with very sharp teeth or cutting edges. This effect goes far beyond a normal abrasive action in that the sharp cutters are effective to create a series of impacts or compressive stress concentrations on the surface to cause a break away of the material at the point of impact or compressive stress failure—thus the spalling effect.

It will be observed that the axis of each of the crush grinder clusters lies along a line which defines a radius of the spiders arms. It is true, of course, that the crush grinder clusters may be mounted slightly askew, that is, with their axes not in such alignment. In that case not only would a crush grinding effect be obtained by in addition there would be obtained also a slight abrasive action on the surface being processed.

The crush grinder assembly 14 may be secured to the drive shaft 24 by any suitable arrangement such for example as by means of a pin 62.

While I have illustrated herein a pair of spiders interconnected by a flexible coupling it also would be possible to interconnect on a single driving shaft co-axially more than two spiders generally of the type disclosed herein by flexible coupling means.

A spacer block 63 is seated on the upper end of the bearing housing 22 and has seated thereupon the gear motor 16 which is drivingly connected to the upper end of the drive shaft 24 by a flexible coupling 64.

A gear motor controller 65 is mounted at the operator end of handle assembly 66 for convenient on-off control.

The wheel carriage assembly 18 includes the four wheels 68. Each of the wheels 68 are maintained in spring loaded contact by compression spring 69 with the floor surface which is being processed. The wheels act to guide the machine in a straight line. This has the effect of counteracting any reaction torque generated by the rotation of the crush grinder assembly with respect to the floor.

Each of the wheels is supported on a wheel axle support 70 and block 72, the latter being rigidly mounted to the main frame by means of the structural angle member 74 which is secured to the frame 12. Elongated arm member 76 is fixed to the axle support 70 and is keyed against rotation by means of pin 78 which rides in slot 80 in block 72. A roller cam follower 82 is rotatably mounted at the upper end of elongated member 76. A cam plate member 84 is pivotally mounted by means of a pin 86 on the support or structural angle member 74. A cam plate member such as 84 is associated with each of the wheel assemblies and these are designated at 84A, 84B, 84C and 84D in the drawings. The cam members 84A and 84B on the right hand side of the machine are pivotally interconnected by connecting rod 88 and cam members 84C and 84D on the left hand side of the machine are connected by connecting rod 90. A crank handle 92 is ridigly connected to rear cam plate 84A in such a manner that when the crank handle is rotated counter-clockwise more than 90° the cam plates pivot about their respective pivot pins 86 and force the wheels down relative to the machine assembly as a whole thereby in effect lifting the crush grinder assembly from the ground and allowing the machine to be moved on the wheels alone. Rod 94 connects the rear cam plates 84A and 84C so that all four wheels act in unison as a result of the rotation of the crank handle 92.

A circumferentially extending skirt or shroud 96 is attached at the lower portion of the main frame 12 of the apparatus to form an enclosure around the crush grinder assembly and to contain the dust generated by the dry finishing process. This shroud is positioned within a fraction of an inch of the surface bieng processed to effectively contain the dust generated during the finishing process. A vacuum filter arrangement 98 is mounted at the forward end of the apparatus and includes a pair of flexible hoses 100 which communicate with the enclosed area around the crush grinder assembly area to pick up the dust generated within the shrouded enclosure.

The on-off control switch for the vacuum filter arrangement 98 also may be contained in the gear motor controller box 65.

The surfacing machine 10 also may include as an optional improvement a means for inducing vibratory energy to the crush grinder assembly. The purpose of such an arrangement is to increase the energy transmitted to the crush grinding cutter clusters and thereby increase the rate of material removal. To accomplish this a vibrator 102 is mounted on the modified spacer block 104 by means of rigid posts 106, the whole assembly being bolted together to form a rigid arrangement. The vibrator 102 comprises a dual eccentric weight device wherein a weight is positioned on each end of a rotor shaft which is directly driven by an electric motor positioned between the two weights. The vibrator is so mounted that the vibratory energy, which is of high frequency and low amplitude is directly and efficiently transmitted to the crush grinder assembly 14 and, therefore, to the individual cutter discs 48. The on-off control switch for the vibrator may be contained in box 65.

In operation when the crush grinder assembly is rotated the clusters of cutter discs are moved rapidly over the surface and under the force of the normal weight of the machine. Weight may be added to increase the unit loading on the discs. A concentrated loading is being continually applied to each portion of the cutter disc in contact with the surface and this is effective to chip away the surface under compressive loading failure in the immediate area of each cutter tooth in contact with the surface—an effect known as spalling. Because there are so many points in contact side by side no one tooth can dig into the surface too deeply. Thus to expose the terrazzo aggregate the crush grinder assembly is moved over the surface repeatedly to accomplish the desired surface removal.

It is contemplated that the crush grinder clusters 42 may be incorporated on existing machines which presently use abrasive blocks or grinding stones. Such a general arrangement is illustrated in FIG. 9 which shows a bottom plan view of an arrangement of a pair of intermeshing three-arm spiders 110 on parallel axes as used in existing commercial equipment. In that equipment, however, abrasive blocks are used and I have illustrated how crush grinder clusters 42 may be incorporated in such equipment in place of the normally used abrasive blocks.

The co-axially disposed and interconnected three-arm spider arrangements described herein may also be used in other types of equipment utilizing abrasive grinding stones, buffing pads and the like.

It will be apparent that I have advantageously provided an improved cement and terrazzo surfacing machine embodying an improved crush grinder assembly. The processing can be done dry. With respect to terrazzo floors rough finishing can be accomplished with this equipment any time after a three-day curing period. By contrast with machines using abrasive stones requiring heavy equipment, the equipment here can be relatively light since concentrated loading on sharp cutter teeth or knife edges achieves a spalling effect.

While certain preferred embodiments of the invention have been disclosed it will be appreciated that these are shown by way of example only, and the invention is not to be limited thereto as other variations will be apparent to those skilled in the art and the invention is to be given its fullest possible interpretation within the terms of the following claims.

What is claimed:

1. An apparatus for finishing terrazzo surfaces and the like comprising a main frame;

motor drive means mounted on said main frame for rotatably driving a finishing tool assembly;

a finishing tool assembly connected to said motor drive means, said finishing tool assembly including a pair of co-axially disposed and interconnected three-arm spiders, a flexible coupling interconnecting said pair of spiders for allowing planar flexibility therebetween, and finishing tool means connected to the end of each spider arm.

2. The apparatus of claim 1 including a wheel carriage assembly connected to said main frame, and means connected to said main frame for adjusting said wheel carriage between raised and lowered positions.

3. The apparatus of claim 1 including a motor driven vibrator unit mounted above the finishing tool assembly for imparting additional energy thereto.

4. An apparatus for finishing terrazzo surfaces and the like comprising a main frame;

motor drive means mounted on said main frame for rotatably driving a crush grinder assembly;

a crush grinder assembly drivingly connected to said motor drive means, said crush grinder assembly including a pair of coaxially disposed and interconnected three-arm spiders, a flexible coupling interconnecting said pair of spiders for allowing planar flexibility therebetween, a crush grinder cluster connected to the end of each spider arm, each of said crush grinder clusters including a disc support bracket and plurality of cutting discs rotatably supported on a common axis in said disc support bracket, and said cutting discs being adapted to rotate freely on said common axis independently of the other cutting discs in the cluster.

5. The apparatus of claim 4 including means preventing relative angular movement between said interconnected pair of spiders.

6. The apparatus of claim 4 wherein the arms of one spider are longer than the arms of the other spider and the crush grinder clusters on said longer spider arms are positioned at a greater radial distance from the center of said crush grinder assembly than the crush grinder clusters on said shorter spider arms.

7. The apparatus of claim 4 including a wheel carriage assembly connected to said main frame, and means connected to said main frame for adjusting said wheel carriage between raised and lowered positions.

8. The apparatus of claim 7 wherein said wheel carriage assembly includes a plurality of wheels and spring means associated independently with each wheel for urging said wheel into a ground engaging position.

9. The apparatus of claim 4 including a motor driven vibrator unit mounted above the crush grinder assembly for imparting additional energy to the crush grinder assembly.

10. The apparatus of claim 4 wherein each of said cutting discs has a plurality of cutting teeth formed on its periphery.

11. An apparatus for finishing terrazzo surfaces and the like comprising;

a main frame;

a bearing housing supported on said main frame;

an intermediate drive shaft rotatably supported in said bearing housing;

a gear motor mounted on said bearing housing for rotatably driving a crush grinder assembly;

a crush grinder assembly connected to said intermediate drive shaft, said crush grinder assembly including a pair of coaxially disposed and interconnected three-arm spiders, a flexible coupling interconnecting said two spiders, said flexible coupling being effective to allow planar flexibility between said two spiders, a crush grinder cluster connected to the end of each spider arm, each of said crush grinder clusters including a plurality of cutting discs, said cutting discs being arranged in a cluster on an axis substantially parallel to the radius of the spider arm to which said crush grinder assembly is connected.

12. The apparatus of claim 11 including means preventing relative angular movement between said interconnected pair of spiders.

13. The apparatus of claim 11 including a wheel carriage assembly connected to said main frame, and means connected to said main frame for adjusting said wheel carriage assembly between raised and lowered positions.

14. The apparatus of claim 13 wherein said wheel carriage assembly includes a plurality of wheels and spring means associated independently with each wheel for urging said wheel into a ground engaging position.

15. The apparatus of claim 11 wherein each of said cutting discs has a plurality of cutting teeth formed on its periphery.

* * * * *